United States Patent [19]

Stapleton

[11] Patent Number: 4,722,098

[45] Date of Patent: Feb. 2, 1988

[54] COSTUME

[76] Inventor: Lorne R. Stapleton, Box 6028, Station "A", Calgary, Alberta, Canada, T2H2L3

[21] Appl. No.: 43,261

[22] Filed: Apr. 1, 1987

[51] Int. Cl.[4] ..... A41D 11/00

[52] U.S. Cl. ..... 2/69; 2/80; 2/79; 446/28; D2/35

[58] Field of Search ..... 2/69, 71, 72, 79, 80, 2/227; 446/26, 28; 272/9; D2/35, 37

[56] References Cited

U.S. PATENT DOCUMENTS

| | | | |
|---|---|---|---|
| 1,267,567 | 5/1918 | Lundgren | 446/28 X |
| 2,412,241 | 12/1946 | Abrahamson | 2/80 X |
| 2,738,974 | 3/1956 | Vincent | 446/28 X |
| 4,154,183 | 5/1979 | Nunez | 2/79 X |
| 4,280,292 | 7/1981 | Hills | 446/28 X |

*Primary Examiner*—Louis K. Rimrodt
*Assistant Examiner*—J. L. Olds
*Attorney, Agent, or Firm*—George H. Dunsmuir

[57] ABSTRACT

A costume designed for use on the legs and lower body to give the impression that the wearer is being carried by a human or other animal figure includes a hollow animal figure with an open topped body portion and leg portions, and a pair of conventional trousers on the top end of the animal figure. The trousers having openings in the top rear of the legs so that the legs of a user can be inserted through such openings into the body portion and leg portions of the animal figure. Socks are provided on the bottom ends of the legs of the trousers, and the legs and socks are filled with padding to give the impression that they are being worn by the user.

6 Claims, 3 Drawing Figures

COSTUME

BACKGROUND OF THE INVENTION

This invention relates to a costume.

More specifically, the invention relates to a costume of the type which would normally be worn on Halloween or to a masquerade. Costumes of the type in question are many and varied, and usually cover all or a portion of the body of a wearer to alter the wearer's appearance. However, there is always room for innovation in the costume field.

The object of the present invention is to provide a costume, which while structurally simple gives the clever allusion that the wearer of the costume is being carried by an animal figure which forms part of the costume.

BRIEF SUMMARY OF THE INVENTION

Accordingly, the present invention relates to a costume comprising a substantially hollow animal figure of the type including a body portion and leg portions for receiving the legs of a wearer, said body portion having at least one opening in the upper end thereof for admitting the legs of a wearer; and conventional trousers on said top end of the body portion giving the impression that the animal figure is carrying the wearer of the animal figure when in use, at least one opening in said trousers communicating with the opening in the body portion of the animal figure permitting insertion of the legs of a user through the trousers into the animal figure.

It should be noted that the expression "animal figure" used herein is intended to mean a human or animal figure, i.e. the so-called animal figure can resemble a human being or an animal such as a gorilla.

BRIEF DESCRIPTION OF THE DRAWINGS

The invention will be described in greater detail with reference to the accompanying drawing, which illustrates a preferred embodiment of the invention, and wherein.

DESCRIPTION OF THE PREFERRED EMBODIMENTS

Figure 1:
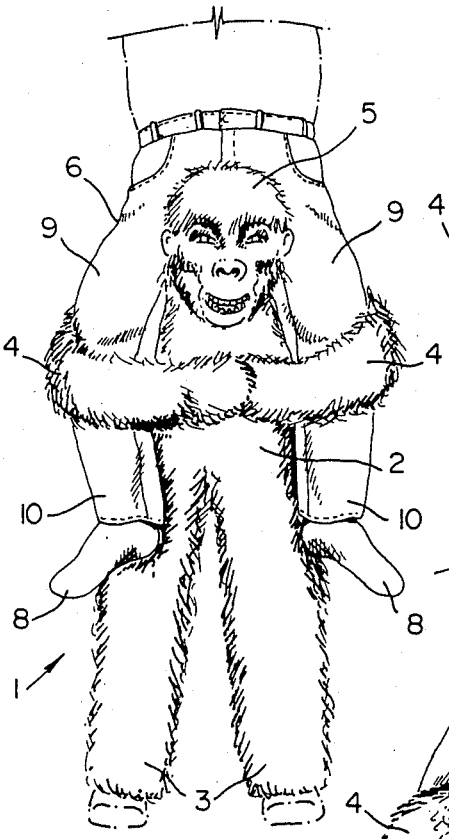
FIG. 1 is a front view of a costume of the present invention in use.

With reference to the drawing, the costume of the present invention includes an elongated animal figure generally indicated at 1 which in this case is a gorilla. The animal FIG. 1 is defined by a hollow body portion 2, a pair of hollow legs 3, arms 4 and a head 5. The FIG. 1 is used in combination with a conventional pair of trousers 6 and socks 8. The arms 4 of the animal FIG. 1 are hollow, but can contain soft padding (not shown) to give them bulk. The arms 4 extend around the legs 9 of the trousers 6 and are connected together at the hand ends thereof.

The socks 8 are attached to the bottom ends 10 of the trouser legs 9, and both the legs 9 and the socks 8 are filled with soft padding to give the appearance that they contain the legs and feet of the wearer of the costume.

Figure 3:
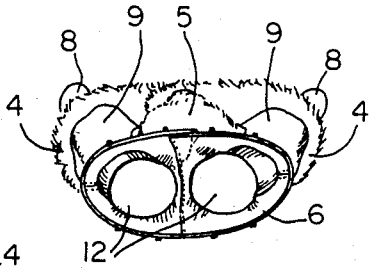
FIG. 3 is a plan view of the costume of FIGS. 1 and 2.
Figure 2:
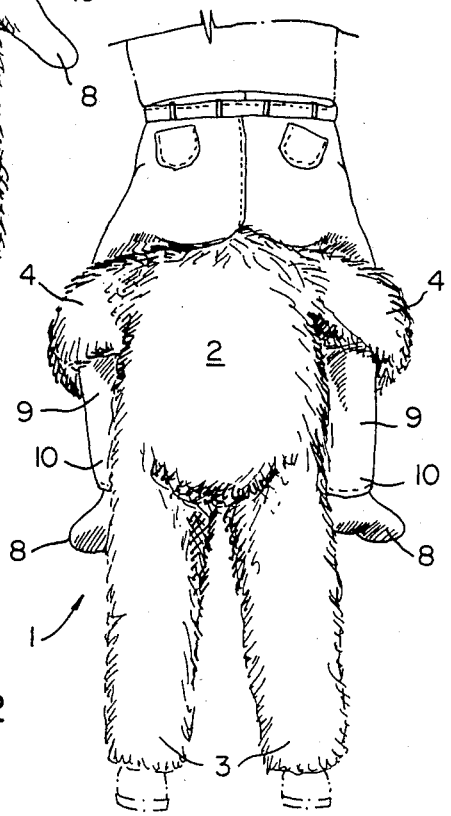
FIG. 2 is a rear view of the costume of FIG. 1 in use.

In order to produce the costume, openings 12 (FIG. 3) are cut into the top rear of the legs 9 of the trousers 6, and the trousers are connected to the open top end of the animal FIG. 1. In use, the wearer's legs pass through the top end of the trousers 6, the body portion 2 and the legs 3 of the animal FIG. 1. In the use position of the costume, the tops of the wearer's legs are covered by the body portion 2 of the animal FIG. 1.

It will be appreciated that the animal FIG. 1 can be the gorilla shown in the drawing, another animal, a politician or other human figure. The costume is complete in itself, and can readily be put on a user in the same manner as a pair of trousers. Of course, the leg portions of the animal figure can be any length.

What is claimed is:

1. A costume comprising a substantially hollow animal figure of the type including a body portion and leg portions for receiving the legs of a wearer, said body portion having at least one opening in the upper end thereof for admitting the legs of a wearer; and conventional trousers on said top end of the body portion giving the impression that the animal figure is carrying the wearer of the animal figure when in use, at least one opening in said trousers communicating with the opening in the body portion of the animal figure permitting insertion of the legs of a user through the trousers into the animal figure.

2. A costume according to claim 1, wherein the legs of the trousers are wrapped around the head and neck of the animal figure to give the impression that the wearer of the costume is being carried on the shoulders of the animal figure.

3. A costume according to claim 2, wherein said trousers include openings in the top rear surfaces of the leg portions thereof so that the legs of a user can be inserted through such openings into the open top end of the body portion of the animal figure.

4. A costume according to claim 1, including padding in the leg portions of said trousers; and sock means on the bottom ends of said trouser leg portions.

5. A costume according to claim 2, including padding in the leg portions of the said trousers; and sock means on the bottom ends of said trouser leg portions.

6. A costume according to claim 3, including padding in the leg portions of the said trousers; and sock means on the bottom ends of said trouser leg portions.

* * * * *